US006091369A

United States Patent [19]

Baek et al.

[11] Patent Number: 6,091,369

[45] Date of Patent: Jul. 18, 2000

[54] TELESCOPIC ANTENNA ASSEMBLY FOR PORTABLE PHONE

[75] Inventors: Rack June Baek, Seoul; In Soo Whang, Anyang, both of Rep. of Korea

[73] Assignee: Ace Technology, Rep. of Korea

[21] Appl. No.: 09/318,729

[22] Filed: May 26, 1999

[30] Foreign Application Priority Data

| | | | |
|---|---|---|---|
| May 27, 1998 | [KR] | Rep. of Korea | 98-19122 |
| Jun. 11, 1998 | [KR] | Rep. of Korea | 98-21612 |
| Jul. 23, 1998 | [KR] | Rep. of Korea | 98-29573 |

[51] Int. Cl.[7] ..... H01Q 1/24

[52] U.S. Cl. ..... 343/702; 343/895; 343/901

[58] Field of Search ..... 343/702, 901, 343/903, 895, 872

[56] References Cited

U.S. PATENT DOCUMENTS

| | | | |
|---|---|---|---|
| 5,317,325 | 5/1994 | Bottomly | 343/702 |
| 5,353,039 | 10/1994 | Baldry | 343/702 |
| 5,467,096 | 11/1995 | Takamoro et al. | 343/702 |
| 5,504,494 | 4/1996 | Chatzipetros et al. | 343/702 |
| 5,546,094 | 8/1996 | Egashira | 343/702 |
| 5,594,459 | 1/1997 | Hirota | 343/702 |
| 5,650,789 | 7/1997 | Elliott et al. | 343/702 |
| 5,661,496 | 8/1997 | Baek et al. | 343/702 |

*Primary Examiner*—Tan Ho

*Attorney, Agent, or Firm*—Finnegan, Henderson, Farabow, Garrett & Dunner, L.L.P.

[57] ABSTRACT

An antenna assembly for reducing the receiving space in a portable phone which employs the antenna assembly and for enhancing the bandwidth and radiation efficiency when the antenna assembly is in a retracted position. The antenna assembly includes a helical antenna and a whip antenna. The helical antenna is powered by capacitive coupling between a conductive layer therein and a feed conductor electrically connected to a signal processing circuit in the portable phone. Also, the whip antenna consists of two stages in a vertical direction in a manner that one of the stages can be retracted into the other one. The helical antenna includes a conducting layer disposed beneath the helical element; the feed conductor electrically connected to the signal processing circuit at least when said antenna assembly is retracted into the portable phone; and an insulating layer disposed between the conducting layer and the feed conductor. The whip antenna includes a spring attached to the antenna rod; a tube having a cylindrical shape capable of receiving at least lower half of the antenna rod; and a stopper attached to the bottom end of the tube and contacting the antenna rod selectively. The tube has a sill at the top end thereof for holding and preventing the spring attached to the antenna rod from slipping out of the tube

4 Claims, 12 Drawing Sheets

TELESCOPIC ANTENNA ASSEMBLY FOR PORTABLE PHONE

BACKGROUND OF THE INVENTION

1. Field of the Invention

The present invention relates to an antenna, and more particularly, to an antenna for use in a portable telephone, such as a cellular phone.

2. Description of the Related Arts

In light of the developments of wireless communications technology and the reduction of terminal prices, portable phones such as cellular phones and personal communications service (PCS) phones have been popularized and are widely being used. In a portable phone, an antenna assembly typically includes a whip antenna having an electrical length of $\lambda/4$ and a helical antenna which is attached on the top end of the whip antenna and has an electrical length of $\lambda/4$ also.

One example of conventional antenna assemblies having such a configuration is illustrated in FIG. 1. In the antenna assembly of FIG. 1, a helical antenna 12 is installed displaced by a certain space from the top end of an antenna rod of the whip antenna 10, so that undesired resonance due to an electromagnetic coupling between the whip antenna 10 and the helical antenna 12 is negligible. When a portable phone employing the antenna assembly shown in FIG. 1, is in a stand-by state, a user of the phone usually retracts the antenna into the phone. In this position, only the helical antenna is effective on the antenna characteristics. Meanwhile, when the portable phone is in a call-attempt or a call receiving state, the user usually extends the antenna from a housing of the phone. In such a case, the helical antenna as well as the whip antenna affects the antenna characteristics along.

FIG. 2 shows another example of conventional antenna assemblies. In FIG. 2, a helical antenna 22 is attached to the top end of an antenna rod of a whip antenna 20. In the conventional antenna assembly of FIG. 2, the helical antenna 22 is in constant electrical connection with the antenna rod. When the antenna assembly of FIG. 2 is in its extended position, the helical antenna 22 of $\lambda/4$-length and the whip antenna 20 of $\lambda/4$-length show a combined characteristics of an antenna of $\lambda/2$-length. Meanwhile, when the antenna assembly of FIG. 2 is in its retracted position, only the helical antenna 22 of $\lambda/4$-length affects the antenna characteristics.

The antenna assembly of FIG. 1 or FIG. 2, is disadvantaged in that the bandwidth is narrow. Thus, the radiation efficiency thereof is not good, particularly when the antenna assembly is in its retracted position. Furthermore, the portable phone employing the antenna assembly has to be provided with ample space therein for receiving the antenna assembly when the antenna assembly is retracted. This creates an obstacle in the reduction of the size of the phone.

FIG. 3 shows yet another example of conventional antenna assemblies. A helical antenna 32 is attached and fixed on a housing of the phone and a whip antenna 30 is installed so as to be movable upward and downward through the inside the helical antenna 32. In such an antenna assembly, the whip antenna 30 and the helical antenna 32 are operative in parallel when the whip antenna 30 is extended, while only the helical antenna 32 is operative when the whip antenna 30 is retracted. While the antenna assembly of FIG. 3 has the advantage of having the helical antenna 32 fixed firmly on the phone, the antenna assembly also has the disadvantage of requiring more space inside the phone. The antenna assembly of FIG. 3 requires more space inside the phone because the top end of the whip antenna should be lower than the bottom end of the helical antenna in order to avoid an undesired electromagnetic coupling between the helical antenna and the whip antenna when the whip antenna is retracted.

Meanwhile, the size of the portable phones is generally getting smaller to enhance the convenience in carrying the phone. Also, due to the transition of the frequency bands employed in wireless communication systems towards higher frequencies, the components in the phone and the phone itself are further being miniaturized in their size. In light of the trend of miniaturization, it is desired to reduce the physical length of the portion of the antenna assembly received in the housing body of the portable phone when the antenna assembly is in a retracted position, along with the receiving space in the housing body. Meanwhile, it is also desired that the bandwidth of the helical antenna is enlarged and the antenna characteristics are stabilized. Additionally, it is desired to achieve these objectives while minimizing the size of the antenna.

SUMMARY OF THE INVENTION

Additional aspects and advantages of the invention will be set forth in part in the description which follows, and in part will be obvious from the description, or may be learned by practice of the invention. To achieve the objects and in accordance with the purpose of the invention, as embodied and broadly described herein, the invention comprises of the invention can be seen upon review of the figures, the detailed description, and the claims which follows.

The object of the present invention is to provide an antenna assembly for reducing the receiving space in a portable phone which employs the antenna assembly and for enhancing the bandwidth and radiation efficiency when the antenna assembly is in a retracted position.

In order to achieve the above object, an antenna assembly according to the present invention includes a helical antenna and a whip antenna. The helical antenna is powered by capacitive coupling between a conductive layer therein and a feed conductor electrically connected to a signal processing circuit in the portable phone. Also, the whip antenna consists of two stages in a vertical direction in a manner that one of the stages can be retracted into the other one.

The helical antenna includes a helical element having a spiral shape, and transmits and receives a signal by being electrically connected to the signal processing circuit in the portable phone at least when said antenna assembly is retracted into the portable phone. The helical antenna further includes a conducting layer disposed beneath the helical element; a feed conductor electrically connected to the signal processing circuit at least when said antenna assembly is retracted into the portable phone; and a insulating layer disposed between the conducting layer and the feed conductor.

The whip antenna includes an antenna rod for transmitting and receiving the signal by being electrically connected to the signal processing circuit when the antenna assembly is extended from the portable phone. The whip antenna further includes a spring attached to the antenna rod; a tube having a cylindrical shape capable of receiving at least the lower half of the antenna rod; and a stopper attached to the bottom end of the tube and contacting the antenna rod selectively. The tube has a sill at the top end thereof for holding and preventing the spring attached to the antenna rod from slipping out of the tube.

In a preferred embodiment, the feed conductor of the helical antenna is mounted on and fixed to the top end of the antenna rod of the whip antenna. Meanwhile, in another embodiment, the helical antenna has an aperture penetrating therethrough and is fixed on the portable phone, and the whip antenna is movable upward and downward through the aperture. The antenna rod is comprised of a straight conductor in the preferred embodiments. However, a thin conductor wound in a helical shape may be used for the antenna rod, alternatively.

A feature consistent with the present invention, is to reduce the physical length of the portion of the antenna assembly received in the housing body of the portable phone when the antenna assembly is in a retracted position. Another feature consistent with the present invention, is to reduce the receiving space in the housing body, since the whip antenna is turned out in multiple stages. Another feature consistent with the present invention is to provide a simple structure of the antenna assembly using only a simple sill to define the movable range of the antenna rod in the upper direction. Yet another feature consistent with the present invention, is to increase the capacitance component of the helical antenna. The energy transfer between the feed conductor and the helical element is performed by capacitive coupling because of the insulating layer disposed between the feed conductor and the conducting layer. An increase in the capacitive component of the helical antenna increases the bandwidth of the helical antenna. Additionally the antenna characteristics are stabilized. Furthermore, another feature consistent with the present invention is to enhance the mechanical reliability of the antenna apparatus when the antenna rod is formed by winding a thin conductor in a helical shape and when the antenna cover is formed by a molding process.

It is to be understood that both the foregoing general description and the following detailed description are exemplary and explanatory only and are not restrictive of the invention, as claimed.

The accompanying drawings, which are incorporated in and constitute a part of this specification, illustrate the embodiments of the invention and together with the description serve to explain the principles of the invention.

BRIEF DESCRIPTION OF THE DRAWINGS

The above objectives and advantages of the present invention will become more apparent by describing in detail preferred embodiments thereof with reference to the attached drawings in which.

DETAILED DESCRIPTION OF THE PREFERRED EMBODIMENTS

Reference will now be made in detail to the present preferred embodiments of the invention, an example of which is illustrated in the accompanying drawings. Wherever possible, the same reference numbers or characters will be used throughout the drawings to refer to the same or like parts.

Figure 1:
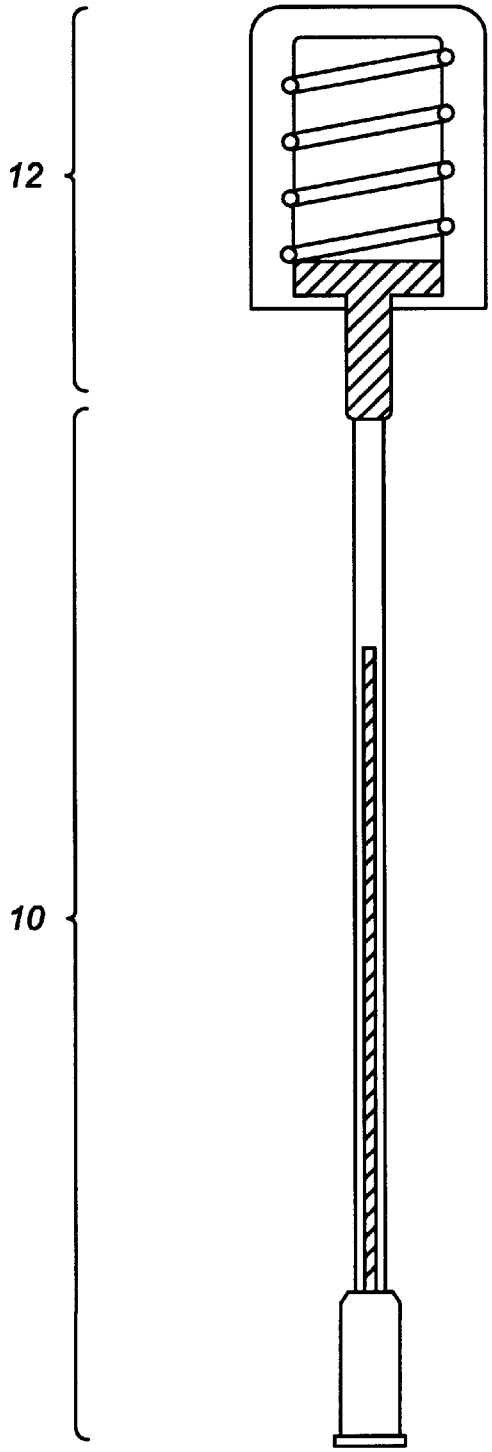
FIG. 1 (PRIOR ART)
FIG. 1 illustrates an example of conventional antenna assemblies.
Figure 2:
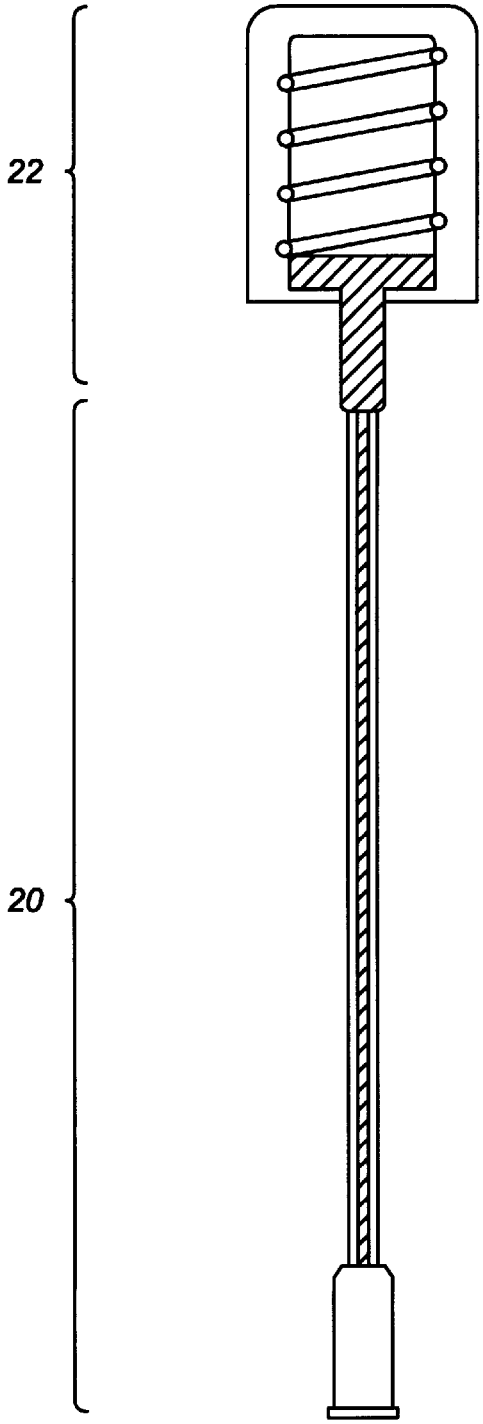
FIG. 2 (PRIOR ART)
FIG. 2 illustrates another example of conventional antenna assemblies.
Figure 3:
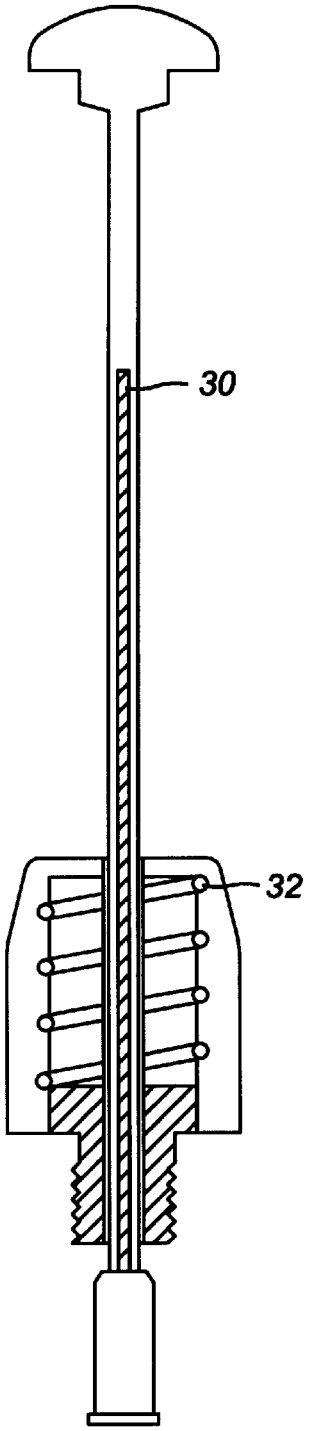
FIG. 3 (PRIOR ART)
FIG. 3 illustrates yet another example of conventional antenna assemblies.
Figure 4:
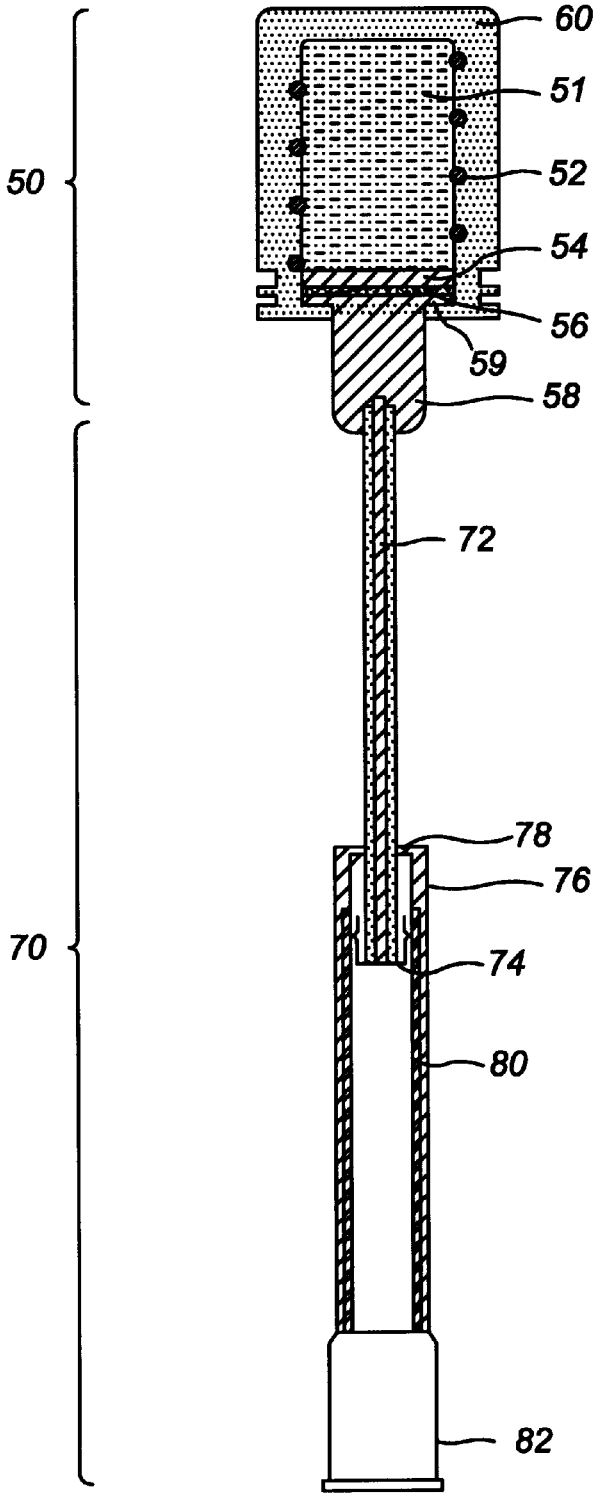
FIG. 4 is a cross-sectional view of an embodiment of the antenna assembly according to the present invention.

Referring to FIG. 4, an embodiment of the antenna assembly according to the present invention includes a helical antenna 50 and a whip antenna 70. The helical antenna 50 includes a helical element 52 wound on an insulator 51, a metal plate 54 disposed beneath the helical element 52, an insulating layer 56 disposed beneath the metal plate 54, and a sleeve 58 disposed beneath the insulating layer 56. In the present embodiment, a signal is transmitted between the metal plate 54 and the sleeve 58 by an electromagnetic coupling. Thus, a flange 59 is formed on the upper end of the sleeve 58 so that a facing surface is wide enough to ensure the signal transmission through the electromagnetic coupling. Meanwhile, an antenna cover 60 encloses the combined structure of the helical antenna 50, the metal plate 54, the insulating layer 56, and the sleeve 58.

The whip antenna 70 includes an antenna rod 72, a tube 76, and a conductive stopper 82. The antenna rod 72 is made of a nickel-titanium alloy and the top end thereof is forcibly fitted to the sleeve 58. Also, a spring 74 is attached at the bottom end of the antenna rod 72 so as to cause a friction when the bottom end of the antenna rod 72 slides inside the tube 76. Meanwhile, the tube 76 includes a sill 78 at its top end for preventing the antenna rod 72 from slipping out of the tube 76 by holding the spring 74. Further, a plate spring 80 is provided on the inner wall of the tube 80 from a location displaced by a certain distance from the top end thereof to the bottom end. In the present invention, the antenna rod 72, the tube 76, and the stopper 82 are electrically connected to one another.

Figure 5:
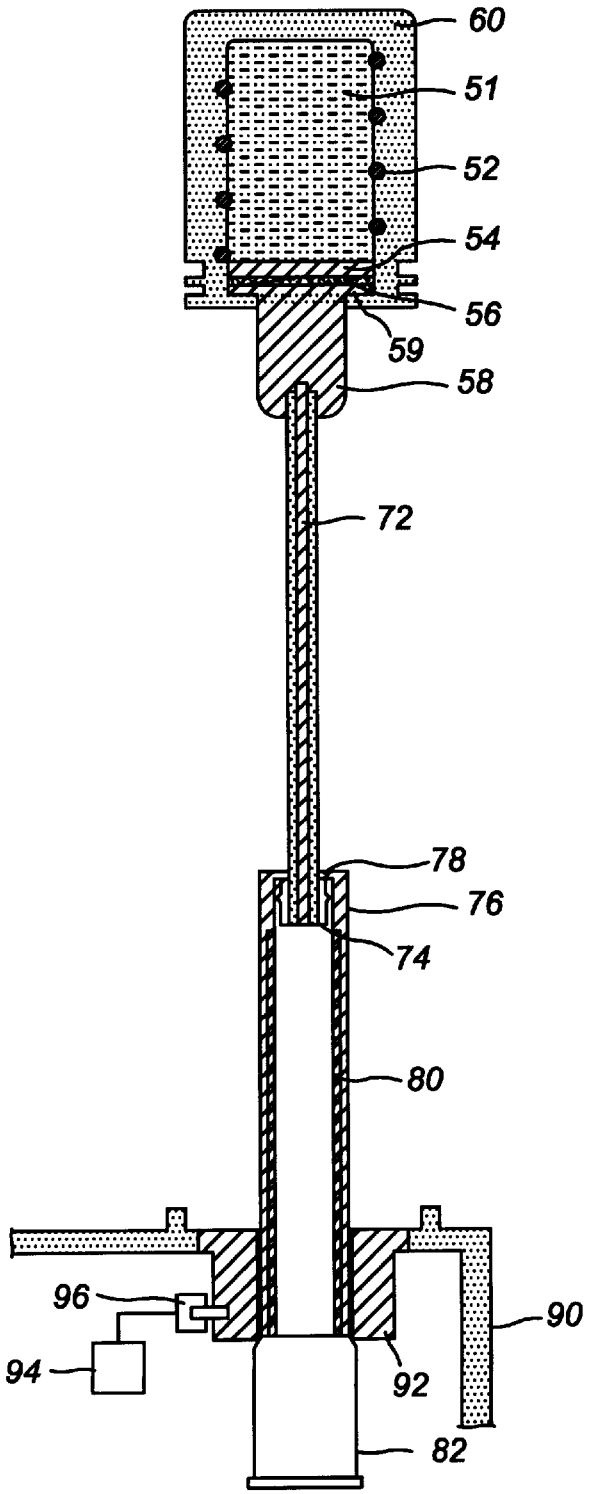
FIG. 5 is a cross-sectional view illustrating the antenna assembly of FIG. 4 when it is installed in and extended from a portable phone.

FIGS. 5 though 8 illustrates the installation and operation of the antenna assembly of FIG. 4. Referring to the figures, the antenna assembly is installed onto the phone as follows. The upper portion of the housing 90 of the phone has a passing-through aperture, and a ring-shaped housing connector 92 is installed within the aperture for electrically connecting the antenna assembly to a signal processing circuit 94. Screw patterns are formed on the inner wall of the aperture of the housing and the outer circumferential surface of the connector 92, and the connector 92 is installed by being screwed into the aperture. The antenna assembly is installed so as to be movable upward and downward inside an aperture through the center of the connecter 92.

The antenna assembly operates as follows. When the antenna assembly is in an extended position as shown in FIG. 5, the stopper 82 is stuck in the aperture of the connector 92 and the spring 74 attached at the bottom end of the antenna rod 72 is held beneath the sill 78 of the tube 76. In such a position, the contact between the connector 92 and the stopper 82 acts as a feed point to the antenna assembly. Power from the signal processing circuit 94 is provided to the whip antenna 70 via the antenna clip 96 and the connector 92, and some portion of the power received by the whip antenna 70 is transmitted to the helical element 52 by capacitive coupling. Thus, the supplied power is radiated as a radio wave by both the helical antenna 50 and the whip antenna 70. Also, the RF signal received by the helical antenna 50 and the whip antenna 70 is provided to the signal processing circuit 94 via the connector 92 and the antenna clip 96.

In such a state, the antenna rod 72 and the tube 76 are combined to constitute a telescopic whip antenna having an electrical length of $\lambda/4$. Further, since the whip antenna 70 is connected to the helical antenna 50 having an electrical length of $\lambda/4$, the antenna assembly operates equivalently to an antenna of $\lambda/2$-length. Meanwhile, the antenna assembly has a shape in which a coil is top-loaded on the whip antenna of $\lambda/4$-length, and thus the radiation efficiency thereof is enhanced.

Figure 6:
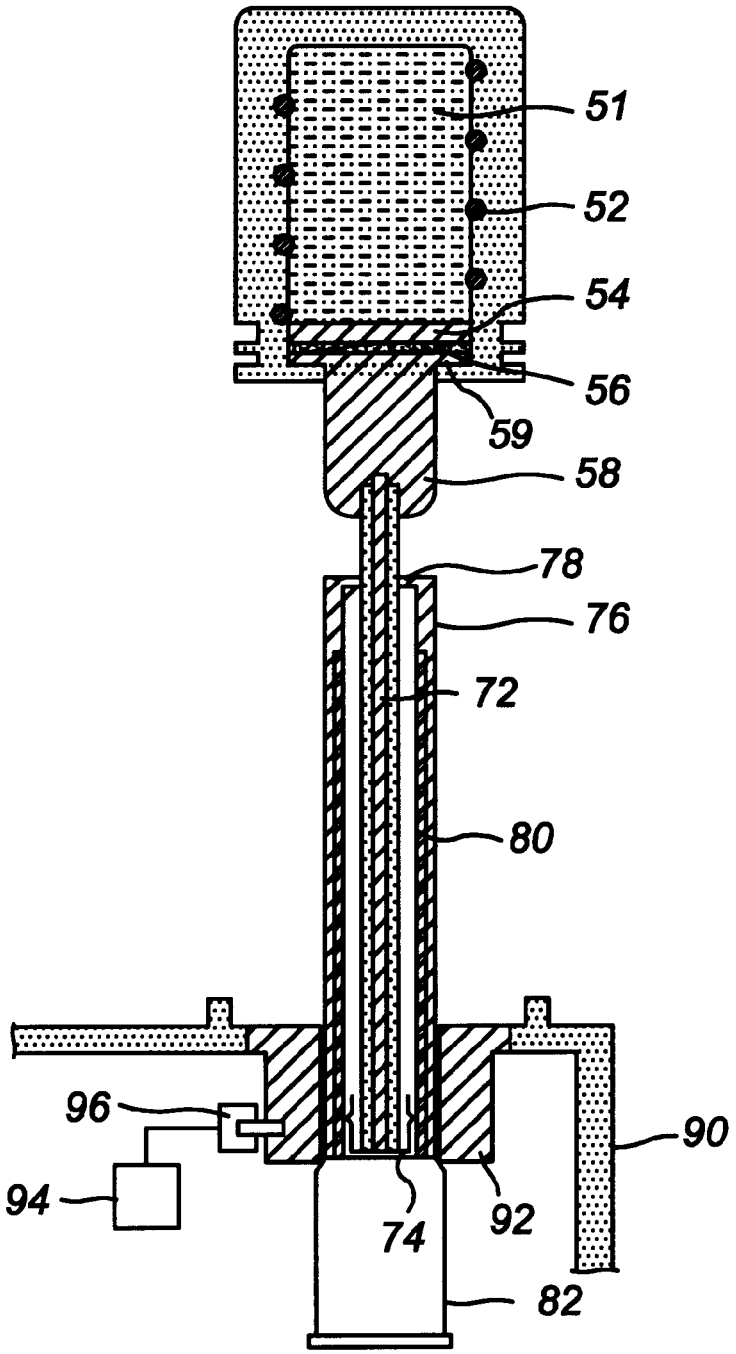
FIG. 6 is a cross-sectional view illustrating the antenna assembly of FIG. 4 in an intermediate step of being inserted into the portable phone.

When a user wishes to retract the whip antenna into the phone in a standby state, for example, the user pushes the helical antenna 50 downward so that the whip antenna 70 slides into the housing body of the phone. In an early stage of the insertion, the tube 76 does not translate but only the helical antenna 50 and the antenna rod 72 moves downward while the spring 74 is guided in the tube 76. If the user continues to push the helical antenna 50, the bottom end of the antenna rod 72 reaches the stopper 82 as shown in FIG. 6. After the arrangement of FIG. 6 is established, the applied pushing pressure acts on the stopper 82 so that the tube 76 is translated downward. If the pushing operation is continued, the whip antenna is inserted into the phone and the sleeve 58 is stuck in the aperture of the connector 92 as shown in FIG. 7.

Figure 7:
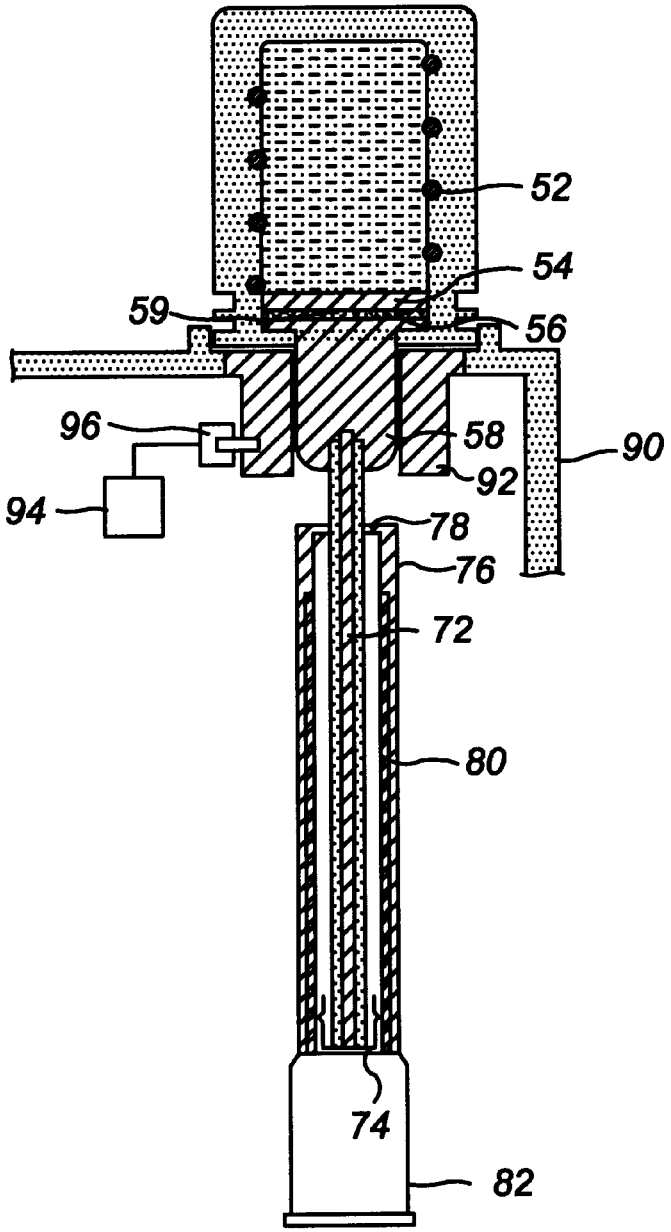
FIG. 7 is a cross-sectional view illustrating the antenna assembly of FIG. 4 when it is installed in and retracted into the portable phone.

When the antenna assembly is in a retracted position as shown in FIG. 7, the helical antenna 50 is operative since the sleeve 58 is stuck in the aperture of the connector 92 and power is transferred between the sleeve 58 and the metal plate 54 by capacitive coupling. At this time, the capacitance component of the helical antenna is increased owing to the capacitive coupling, and thus the bandwidth of the helical antenna is enlarged and the antenna characteristics is stabilized compared with the conventional helical antenna in which power is fed directly.

Figure 8:
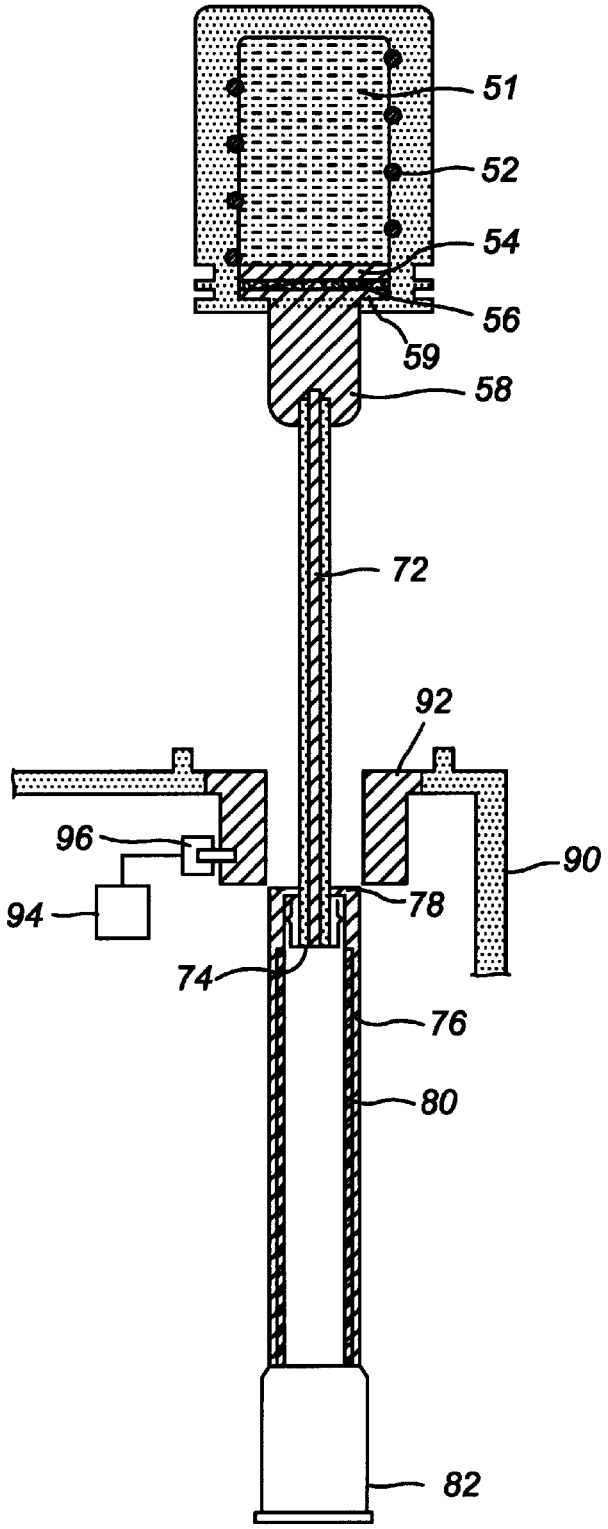
FIG. 8 is a cross-sectional view illustrating the antenna assembly of FIG. 4 in an intermediate step of being retracted into the portable phone.

When the user wishes to extend the antenna assembly from the phone in order to attempt a call or receive an incoming call, the user pulls the helical antenna 50 so that the whip antenna 70 slides out of the housing of the phone. In an early stage of the extension, the tube 76 does not translate but only the helical antenna 50 and the antenna rod 72 moves upward while the spring 74 is guided in the tube 76. If the user continues to pull the helical antenna 50, the spring 74 is held beneath the sill 78 of the tube 76 as shown in FIG. 8. After the arrangement of FIG. 8 is established, the applied pulling force acts on the tube 76 through the spring 74 so that the tube 76 is translated upward. If the pulling operation is continued, the whip antenna reaches the extended position as shown in FIG. 5.

Figure 9:
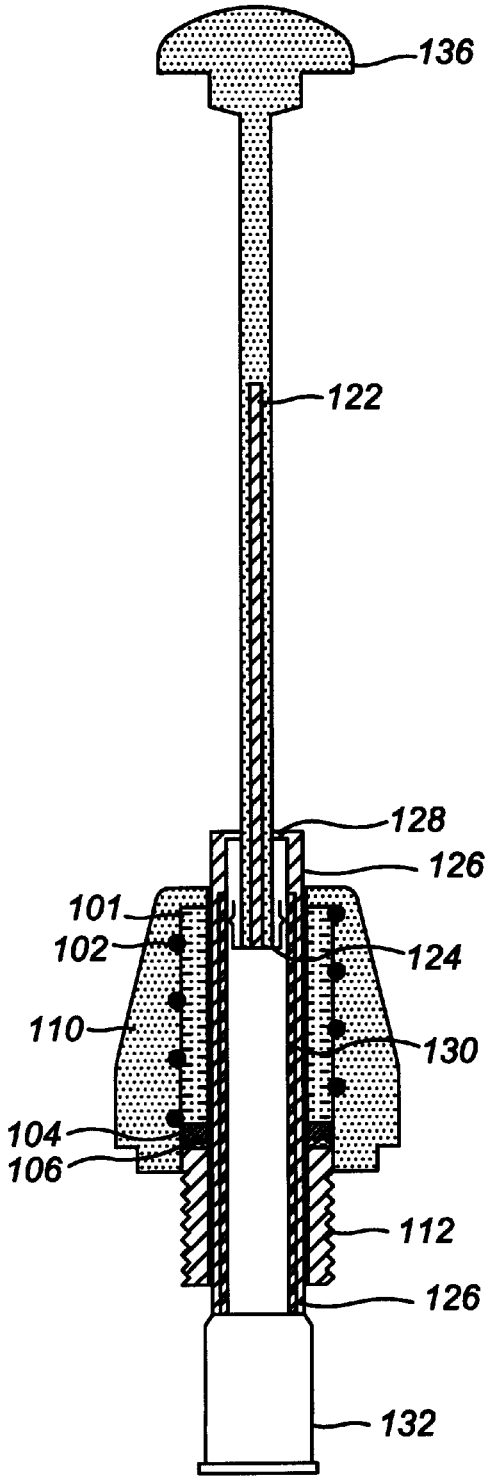
FIG. 9 is a cross-sectional view of another embodiment of the antenna assembly according to the present invention.

FIG. 9 illustrates another embodiment of the antenna assembly according to the present invention, which includes a helical antenna and a whip antenna. In the present embodiment, the helical antenna has a configuration similar to that shown in FIG. 4, and includes an helical element 102 wound on an insulator 101, a metal plate 104 disposed beneath the helical element 102, an insulating layer 106 disposed beneath the metal plate 104, and a sleeve 108 disposed beneath the insulating layer 106. The top surface of the sleeve 108 is wide enough to ensure the signal transmission between the metal plate 104 and the sleeve 108 through electromagnetic coupling.

Meanwhile, an antenna cover 110 encloses the combined structure of the helical antenna 100, the metal plate 104, the insulating layer 106, and the sleeve 108. A screw thread 112 is formed on the outer circumferential surface of the sleeve 108 so that the helical antenna is installed on the housing of the phone by use of the screw thread 112. Also, an aperture having an inner diameter slightly larger than the diameter of the antenna rod is provided passing through the axis of the helical antenna structure, so that the whip antenna is installed through the aperture of the helical antenna structure.

The whip antenna includes an antenna rod 122, a tube 126, and a conductive stopper 82. The antenna rod 122 is made of a nickel-titanium alloy and provided with a knob 136 at the top end thereof for making it easy to extend or retract the whip antenna. Also, a spring 124 is attached at the bottom end of the antenna rod 122 so as to cause friction when the bottom end of the antenna rod 122 slides inside the tube 126. Meanwhile, the tube 126 includes a sill 128 at its top end for preventing the antenna rod 122 from slipping out of the tube 126 by holding the spring 124. Further, a plate spring 130 is provided on the inner wall of the tube 126 extending from a location displaced from the top end thereof to the bottom end. In the present invention, the antenna rod 122, the tube 126, and the stopper 132 are electrically connected to one another.

Figure 10:
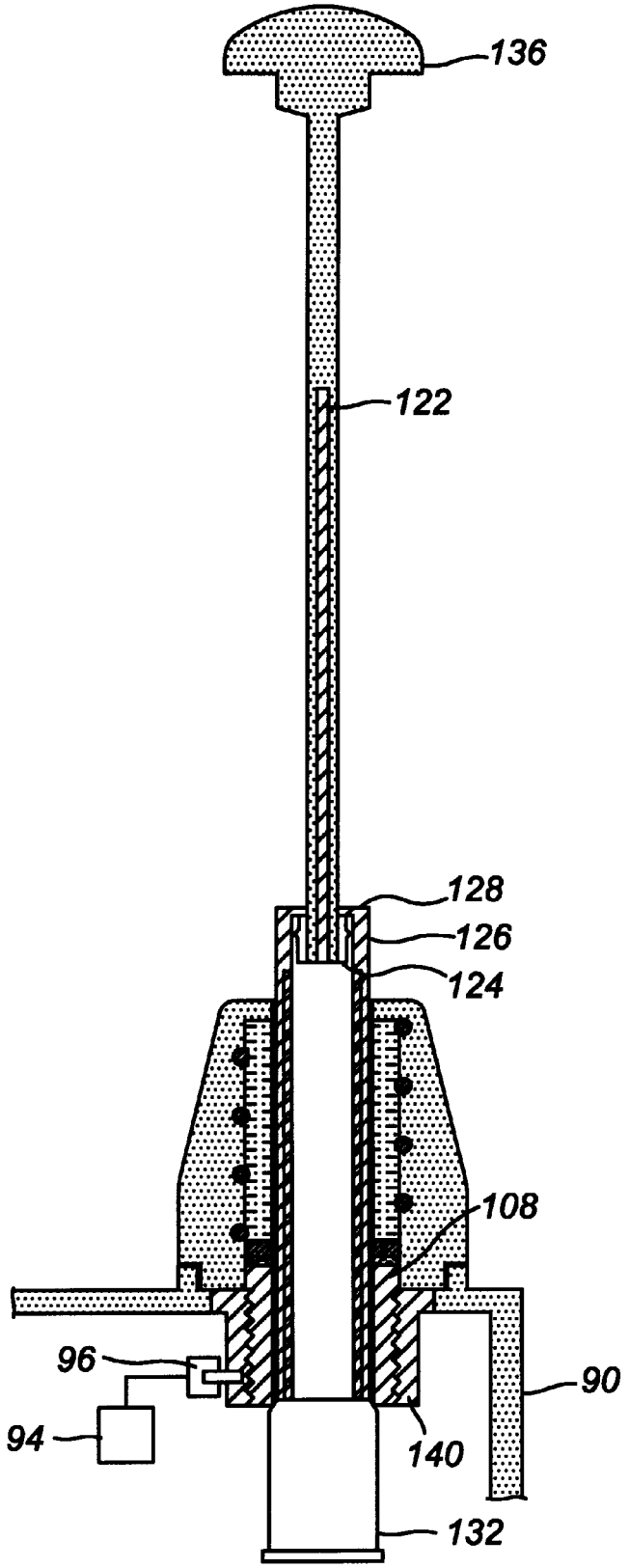
FIG. 10 is a cross-sectional view illustrating the antenna assembly of FIG. 9 when it is installed in and extended from the portable phone.
Figure 11:
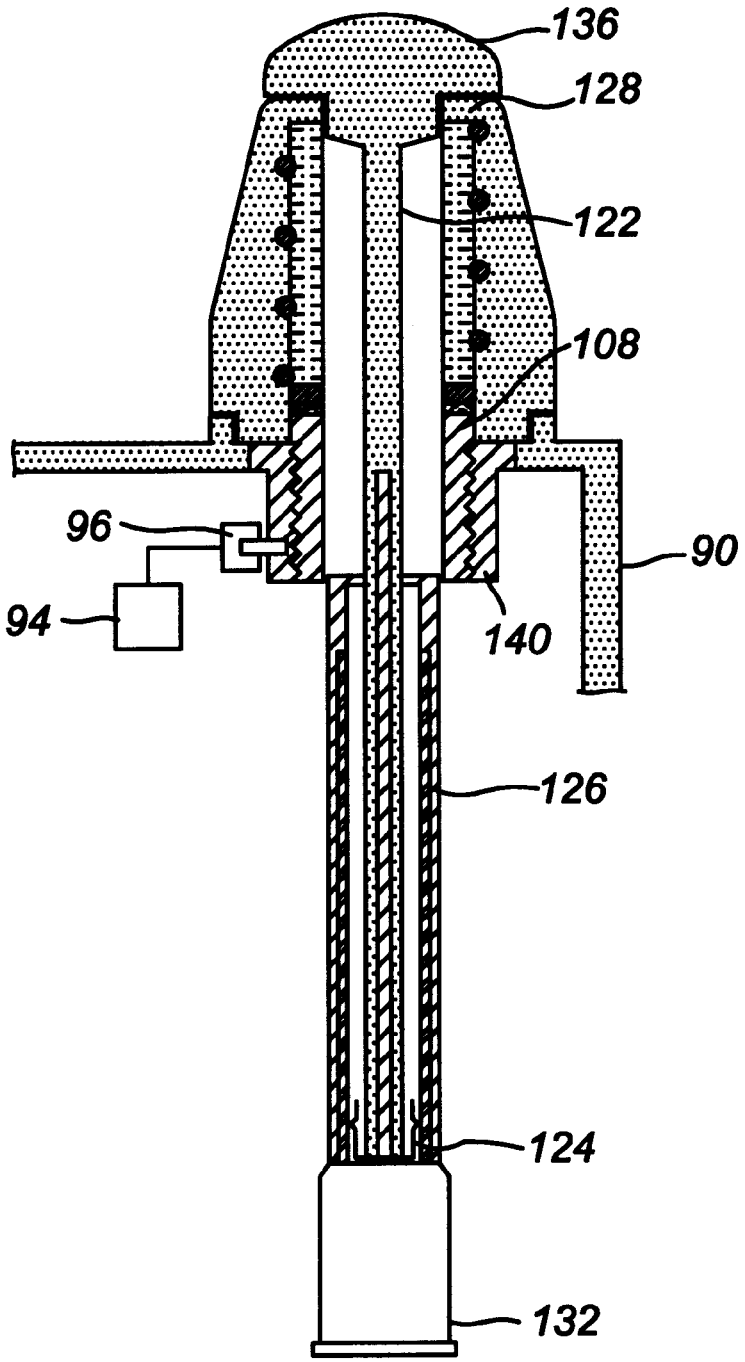
FIG. 11 is a cross-sectional view illustrating the antenna assembly of FIG. 9 when it is installed in and retracted into the portable phone.

FIGS. 10 and 11 illustrate the antenna assembly of FIG. 9 installed in the portable phone, in the extended position and the retracted position, respectively. Referring to the figures, the antenna assembly is installed onto the portable phone as follows. The upper portion of the housing 90 of the phone has a pass-through aperture, and a ring-shaped housing connector 140 for electrically connecting the antenna assembly to a signal processing circuit 94 of the phone installed inside the aperture. Screw patterns are formed on the inner wall of the aperture of the housing and the outer circumferential surface of the connector 140, and the connector 140 is installed by being screwed into the aperture. Meanwhile, the inner surface of the connector 140 also has a screw thread so that the helical antenna is installed at the connector 140 by use of the screw threads formed on the inner surface of the connector 140 and the outer circumferential surface of the sleeve 108. The whip antenna is installed so as to be movable upward and downward inside the aperture through the center of the helical antenna.

The antenna assembly operates as follows. When the antenna assembly is in the extended position as shown in FIG. 10, the stopper 132 is stuck in the aperture of the connector 140 and the spring 124 attached at the bottom end of the antenna rod 72 is held beneath the sill 78 of the tube 76. In such a position, the contact between the connector 140 and the stopper 132 acts as a feed point to the antenna assembly. Also, the antenna rod 122 and the tube 126 are combined to constitute a telescopic whip antenna having an electrical length of $\lambda/4$. Also, the helical antenna is connected in parallel with the whip antenna. Some portion of the power from a signal processing circuit 94 is provided to the whip antenna via the antenna clip 96 and the connector 140, while the other portion of the power is provided to the helical antenna. Here, power transfer between the sleeve 108 and the helical element 102 is performed by capacitive coupling. Meanwhile, the antenna assembly has a shape in which a coil of $\lambda/4$-length is loaded at the bottom of the whip antenna, and thus the radiation efficiency thereof is enhanced.

When the user wishes to retract the whip antenna into the phone in a standby state, for example, the user pushes the knob 136 downward so that the whip antenna slides into the housing body of the phone. In an early stage of the insertion, the tube 126 does not translate but only the antenna rod 122 moves downward while the spring 124 is guided in the tube 126. When the bottom end of the antenna rod 122 reaches stopper 132, the applied pushing pressure acts on the stopper 132 so that the tube 126 is translated downward. If the pushing operation is continued, the whip antenna is inserted into the phone and the bottom end of the knob 136 is stuck in the aperture of the helical antenna as shown in FIG. 11.

When the antenna assembly is in the retracted position as shown in FIG. 11, the stopper 132 and the tube 126 are electrically isolated from the connector 140 so that no signal is transferred between the signal processing circuit 94 and the whip antenna. Therefore, the whip antenna has no effect on the antenna characteristics in such a position. At this time, however, the helical antenna is operative and can exchange signals with the signal processing circuit 94 since the sleeve 108 is electrically connected to the connector 140. Also, the power transfer between the sleeve 108 and the metal plate 104 is performed by capacitive coupling.

When the user wishes to extend the antenna assembly from the phone to attempt a call or receive an incoming call, the user pulls the knob 136 so that the whip antenna slides out of the housing body of the phone. In an early stage of the extension, the tube 126 does not translate but only the antenna rod 122 moves upward while the spring 124 is guided in the tube 126. If the user continues to pull the helical antenna and the spring 124 is held beneath the sill 128 of the tube 126, the applied pulling force acts to pull up the tube 76. If the pulling operation is continued, the whip antenna reaches the extended position as shown in FIG. 10.

Figure 12:
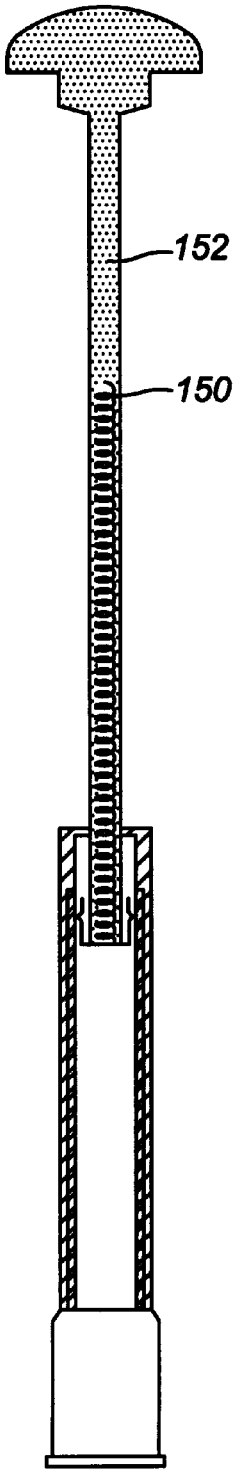
FIG. 12 illustrates the structure of the whip antenna of another embodiment of the antenna assembly according to the present invention.

FIG. 12 shows a structure of the whip antenna in another embodiment of the antenna assembly. The whip antenna of FIG. 12 has a configuration similar to that shown in FIG. 9 except that the antenna rod 150 is formed by winding a thin conductor in a helical shape. In such an alternative, it is preferable to form the antenna cover 152 by a molding process in order that the antenna cover 152 fills the gaps between the pitches of the antenna rod 150 and encloses and protects the rod 150 sufficiently. According to this embodiment, the flexibility of the antenna rod 150 is enhanced, so that the whip antenna is pliable when an external impact is applied and can be restored to its original shape. Thus, the mechanical reliability of the antenna apparatus is enhanced.

Although the present invention has been described in detail above, it should be understood that the foregoing description is illustrative and not restrictive. Those of ordinary skill in the art will appreciate that many obvious modifications can be made to the invention without departing from its spirit or essential characteristics. Accordingly, the scope of the invention should be interpreted in the light of the following appended claims.

What is claimed is:

1. An antenna assembly for use in a portable phone including a signal processing circuit, comprising:

a helical antenna, including a helical element having a spiral shape, for transmitting and receiving a signal by being electrically connected to the signal processing circuit at least when said antenna assembly is retracted into the portable phone; and a whip antenna including an antenna rod for transmitting and receiving the signal by being electrically connected to the signal processing circuit when the antenna assembly is extended from the portable phone, wherein said helical antenna comprises a conducting layer disposed beneath said helical element;

a feed conductor electrically connected to the signal processing circuit at least when said antenna assembly is retracted into the portable phone; and a insulating layer disposed between said conducting layer and said feed conductor, wherein said whip antenna comprises a spring attached to said antenna rod;

a tube having a cylindrical shape capable of receiving at least the lower portion of said antenna rod, said tube having a sill at top end thereof for holding and preventing said spring attached to said antenna rod from slipping out of said tube; and a stopper attached to the bottom end of said tube and selectively contacting said antenna rod.

2. The antenna assembly as claimed in claim 1, wherein said feed conductor of said helical antenna is mounted on and fixed to a top end of said antenna rod of said whip antenna.

3. The antenna assembly as claimed in claim 1, wherein said helical antenna has an aperture therethrough, feed conductor of said helical antenna is fixed on the portable phone, and said whip antenna is movable upward and downward through the aperture.

4. The antenna assembly as claimed in claim 1, wherein said antenna rod is comprised of a thin conductor wound in a helical shape.

* * * * *